United States Patent [19]

Hackett et al.

[11] 3,985,592

[45] Oct. 12, 1976

[54] SURFACE-INHIBITED PROPELLENT CHARGE

[75] Inventors: Clarence Bertram Hackett, Kilmarnock; James Jack, Troon; Richard Paton Reynolds, Largs, all of Scotland

[73] Assignee: Imperial Chemical Industries Limited, London, England

[22] Filed: June 11, 1968

[21] Appl. No.: 738,720

[30] Foreign Application Priority Data

June 13, 1967 United Kingdom ..... 27162/67

[52] U.S. Cl. ..... 149/4; 149/7; 149/9; 149/10; 149/11; 149/14; 149/15; 102/103; 264/3 R

[51] Int. Cl.[2] ..... C06B 45/36

[58] Field of Search ..... 102/103; 149/19, 3, 149/6, 14, 4, 7, 9, 10, 11, 15; 264/3

[56] References Cited

UNITED STATES PATENTS

| | | | |
|---|---|---|---|
| 3,054,253 | 9/1962 | Chung | 102/103 X |
| 3,269,113 | 8/1966 | Crews et al. | 102/103 X |

*Primary Examiner*—Stephen J. Lechert, Jr.
*Attorney, Agent, or Firm*—Cushman, Darby & Cushman

EXEMPLARY CLAIM

1. A surface-inhibited propellent charge comprising a charge of propellent composition having bonded to at least part of its surface an inhibiting layer comprising silicone rubber supported on biaxially-stretchable glass fabric.

19 Claims, No Drawings

SURFACE-INHIBITED PROPELLENT CHARGE

This invention relates to surface-inhibiting material for propellent charges for use in gas generators, cartridge-actuated devices and rocket motors and to propellent charges inhibited by means of said inhibiting material.

Propellent charges for the above application are required to provide a steady supply of gas for long periods, which in some applications may be several minutes. This necessitates controlling the burning surface area of the charge by covering parts of the charge surface where burning is not desirable by a layer of flame-inhibiting material. Commonly, the covered surfaces of cylindrical charges are covered by a layer of inhibiting material leaving an exposed end at which the charge is ignited and burns, the area of burning remaining substantially constant. The inhibiting materials hitherto used have been somewhat unsatisfactory in one or more of the following respects:

a. having a tendency to crack or distort during storage, thus reducing the storage life of the propellent charge;
b. having a tendency to separate from the propellent charge, thereby impairing its function;
c. in physical migration of, for example, plasticiser between the inhibiting material and propellent;
c. in producing, in the combustion gases, solid particles, formed on disintegration of the inhibiting material, which block gas exit ports or erode mechanical parts or gas seals of gas-actuated devices.

It is an object of the present invention to provide a surface-inhibiting material for a propellent charge which is superior in these respects to the materials hitherto employed.

In accordance with this invention a surface-inhibiting material for a propellent charge comprises a layer of silicone rubber supported on biaxially-stretchable glass fabric. Preferably the inhibiting material comprises at least two layers of glass fabric and it is preferred that the silicone rubber should completely cover and impregnate the fabric. The thickness of the inhibiting material should preferably be in the range 0.75 to 2.5 millimeters.

The glass fabric is preferably knitted glass fabric and, for ease of application to a solid propellent charge, is conveniently in the form of a sleeve. Fabric made from glass yarn of 1000–2000 denier is preferred.

The inhibiting material may comprise any silicone rubber, those rubbers disclosed in Rubber Chemistry and Technology 35 (1962) 1222–75 and Annals New York Academy of Sciences 125 (1965) 137–46 being convenient examples. The rubber may be a high temperature cured variety, or a room temperature cured rubber, the latter type being known as R.T.V. (room temperature vulcanized) rubber and being advantageous in inhibiting materials for use with propellents containing nitric esters, since they may be cured at a temperature below the decomposition temperature of nitric esters and so may be safely cured in contact with the propellent charge.

Preferred high temperature cured rubbers include those made from polydimethylsiloxane or polydimethylsiloxane modified by the inclusion of vinyl or phenyl substituents cured by means of a free-radical curing agent such as 2,4-dichlorobenzoyl peroxide. Preferred low temperature curing rubbers, which are especially useful for double-base propellents, include the R.T.V. rubbers described in the aforementioned literature references. Advantageously the R.T.V. rubber may be made from hydroxyl-ended polydimethylsiloxane cured by means of a chain-extending and cross-linking agent such as a. a silicate ester as, for example, ethyl silicate in presence of an organo-tin compound such as dibutyl-tin dilaurate or stannous octoate,
b. an acetoxy silane such as methyl triacetoxysilane in presence of water, or
c. an oxime silane such as methyl tris (acetoximino) silane in presence of water.

The silicone rubbers preferably contain fillers such as silica and may contain pigments.

The inhibiting material of the invention may be prepared by applying a coating of uncured silicone rubber to a supporting structure of biaxially-stretchable glass fabric and curing the applied coating.

In accordance with a further aspect of the invention a surface-inhibited propellent charge comprises a charge of propellent composition having bonded to at least part of its surface an inhibiting layer comprising silicone rubber on a supporting structure of biaxially-stretchable glass fabric. The propellent charge may, for example, be any conventional gas-producing or rocket propellent such as a double-base propellent or a composite propellent comprising an organic fuel binder and an organic nitramine, or the ammonium, alkali metal or alkaline earth metal salts of nitric or perchloric acids or mixtures thereof. The surface-inhibited charge may conveniently be made by coating the surface of the propellent charge with a priming coat of uncured silicone rubber or resin, placing the biaxially-stretchable glass fabric in contact with the priming coat, applying a coating of uncured silicone rubber to the glass fabric and curing the silicone.

The invention is further illustrated by the following Examples in which all parts and percentages are by weight.

EXAMPLE 1

Preparation of double-base propellent

Water-wet nitrocellulose of 12.2% nitrogen content prepared from cotton linters was stirred with water into a slurry containing 49.75 parts nitrocellulose and 500 parts of water and to the stirred slurry were added 34.5 parts of nitroglycerine, 8 parts of di-n-butyl phthalate and 6.5 parts of diethyl diphenyl urea. The slurry was then drained on an endless belt type suction filter and passed between two rubber-covered rollers to remove the bulk of the water. The sheeted paste, which at this stage contained about 40% water, was allowed to mature for 3 days and was then transferred to a Werner-Pfleiderer incorporator and thoroughly mixed with 0.25 parts of mineral jelly for every 98.75 parts of the paste, calculated on a water-free basis, and 9.5 parts of potassium nitrate. After incorporation the paste was passed through hot rough rollers to form partly gelatinised sheets with a water content of approximately 9%. This was dried until the moisture content was below 0.6% and the partly gelatinised sheet was passed repeatedly through hot smooth rolls until it was thoroughly gelatinised.

While still hot the composition was extruded by means of a press through a die of 3.2 cm. diameter to give a solid rod of approximately 3.4 cm. diameter which was cut into lengths of 14.4 cm.

Application of surface-inhibiting material

The silicone rubber used in this Example was a R.T.V. rubber, readily pourable in the uncured state and having the following composition:

| | |
|---|---|
| Linear hydroxyl-ended polydimethylsiloxane having a viscosity of 3,000 centistokes at 25°C | 100 parts |
| Calcium carbonate (average particle size 5 microns) | 40 parts |
| Ethyl silicate | 3 parts |
| Dibutyl-tin dilaurate | 0.5 parts |

Each cylindrical charge of double-base propellent was degreased with trichlorethylene and the surfaces to be inhibited were then coated with a 5% solution of polyvinyl formal in tetrahydrofuran. This was allowed to dry at room temperature (15 to 20 minutes) and a priming coating or solution containing 34% of a polymethylsiloxane resin and 2.5% ethyl silicate in 50/50 acetone/alcohol was applied and allowed to dry (30 minutes). This was followed by one coating of silicone rubber. Two sleeves knitted from 1770 denier glass fibre having a diameter just sufficient to permit them to be drawn on to the propellent charge were first completely impregnated with the silicone rubber and then drawn onto each charge in consecutive operations. Each charge was then rotated around its longitudinal axis in a horizontal plane at about 100 to 150 r.p.m. and a final coat of silicone rubber was applied using a spatula. The silicone rubber was cured for one hour at room temperature while still rotating and for 3 hours stationary at +45°C.

The overall thickness of the layer of inhibiting material was 1.5 mm. and the proportion of silicone elastomer in the layer was approximately 60% by weight.

One end of each propellent charge was inhibited in known manner with a disc of ethyl cellulose.

A portion of the surface-inhibiting material adjacent to the uncovered end of each charge was removed to leave an uncovered "boost stud" 0.63 centimeters long and 3.4 centimeters diameter. A sample of the inhibited charge was tested fresh and after storage for 12 months at +60°C, by firing in a breech with a nozzle designed to give an equilibrium chamber pressure of about 700 lb./in.$^2$. All the charges burned satisfactorily. After storage the inhibiting material showed no signs of separation from the charge and the stored charges burned at a slightly higher rate than the fresh charges but this is the normal effect of hot storage on this type of propellent.

The nitroglycerine content of the layer of inhibiting material in the stored charges was found to be 0.4%.

Similar charges inhibited with a surface layer of ethyl cellulose had very high burning rates and pressures when fired in a breech as described above. The nitroglycerine content of ethyl cellulose removed from these charges after storage for 12 months at 60°C was approximately 14%.

Further samples of the inhibited charges were subjected to cycled storage for 12 months wherein they were stored for 24 hours at +60°C followed by 24 hours at −40°C at the rate of 2½cycles per week, with 48 hours at 20°C between each set of 2½cycles. After 12 months' storage, the charges were fired in a breech as described above and all charges burned satisfactorily.

EXAMPLE 2

The silicone rubber and silicone resin priming coating used in this Example were the same as those used in Example 1.

In this Example a charge of the propellent composition prepared in Example 1, 5 cm. diameter and 17.8 cm. long, was cleaned with trichlorethylene, coated with a 5% solution of polyvinyl formal in tetrahydrofuran which was allowed to dry for 20 minutes, painted with priming coating, and allowed to dry (30 minutes). One coat of silicone rubber was then applied to the cylindrical surface of the charge, followed by four knitted glass sleeves knitted from 1770 denier glass fibre to give an overall thickness of 2.5 millimeters of inhibiting material after cure. The end of the charge was coated with the inhibiting material in a similar manner using 4 discs of knitted glass-cloth impregnated with silicone rubber to give an overall thickness of 4 millimeters after cure.

A brass case was cleaned with trichlorethylene, painted on the inside with a silicone resin priming coat and allowed to dry. Silicone rubber was then poured into the case to a depth of approximately 6 millimeters and allowed to cure for 3 hours at room temperature. The charge was inserted into the case and silicone rubber poured into the annular space between the charge and the case and cured for one hour at room temperature, followed by 3 hours at 45°C. This case-bonded charge gave satisfactory burning rates and pressures when fired in a breech as described in Example 1.

EXAMPLE 3

Preparation of propellent 25 parts of a polyester resin ('Beetle' resin 4134 or 4128) were mixed in a vertical mixer with a double helical blade for 10 minutes. 0.175 parts of a polymerisation catalyst, benzoyl peroxide and 0.175 parts of a polymerisation accelerator, cobalt naphthenate, were added and mixing was continued for a further 10 minutes. A mixture of 30 parts of potassium perchlorate having an average particle size of 250 to 840 microns and 45 parts of potassium perchlorate having an average particle size of 76 to 190 microns was added and mixing continued under a vacuum for 20 minutes. The mixture was then cast into a mould and cured for 16 hours at 60°C.

Application of surface-inhibiting material

The silicone rubber and silicone resin priming coating used in this Example were the same as those used in Example 1.

A cylindrical charge of the above composition, 2.54 cm. diameter, 14.3 cm. long, was degreased with trichlorethylene and brush-coated with the silicone resin priming. After drying at room temperature for 30 minutes one coating of silicone rubber was applied to the charge. Two knitted glass sleeves impregnated with silicone rubber were then applied to the charge as described in Example 1 and one end was covered with four discs of knitted glass-cloth impregnated with silicone rubber. A final coat of silicone rubber was applied and cured as in Example 1.

When fired in a breech as described in Example 1 the charge burned normally and showed no signs of side-burning or nozzle blockage.

EXAMPLE 4

The procedure described in Example 1 for applying a layer of inhibiting material of knitted glass fabric and silicone rubber to a double-base propellent was repeated but in this Example the silicone rubber used was a water-catalysed curing rubber having the following composition:

| | |
|---|---|
| Linear hydroxyl-ended polydimethylsiloxane having a viscosity of 3000 centistokes at 25°C | 100 parts |
| Silica filler (pyrogenic silica of surface area 150cm.²/g.) | 25 parts |
| Methyltriacetoxysilane | 3 parts |

The rubber was cured for one hour at room temperature and 3 hours at 45°C in an atmosphere of 80% relative humidity.

The prepared surface-inhibited charges burned satisfactorily when fired in a breech fresh and after ordinary and temperature-cycled storage as described in Example 1.

EXAMPLE 5

The procedure described in Example 1 was repeated except that the silicone rubber used in this Example was a water-catalysed curing rubber having the following composition:

| | |
|---|---|
| Linear hydroxyl-ended polydimethylsiloxane having a viscosity of 3000 centistokes at 25°C | 100 parts |
| Silica filler (as in Example 4) | 25 parts |
| Tris(acetoximino)methysilane, $CH_3Si(ON{=}C(CH_3)_2)_3$ | 3 parts |

The rubber was cured for one hour at room temperature and 3 hours at 45°C in an atmosphere of 80% relative humidity.

The prepared surface-inhibited charges burned satisfactorily when fired in a breech fresh and after ordinary and temperature-cycled storage as described in Example 1.

EXAMPLE 6

The procedure described in Example 3 was repeated except that a high temperature curing silicone rubber having the following composition was used and cured in air at 150°C for 15 minutes:

| | |
|---|---|
| Linear trimethylsilyl-ended polydimethylsiloxane of average molecular weight 500,000 containing 0.15 mole % of methylvinylsiloxy units and 99.85 mole % of dimethylsiloxy units | 100 parts |
| Fumed silica of average particle size 3–40 microns and surface area of 175 meters²/g. | 40 parts |
| Diphenylsilanediol (structure control additive) | 4 parts |
| Iron oxide | 2 parts |
| 2,4-dichlorobenzoyl peroxide | 1 part |

When fired in a breech as described in Example 1 the charge burned satisfactorily.

What we claim is:

1. A surface-inhibited propellent charge comprising a charge of propellent composition having bonded to at least part of its surface an inhibiting layer comprising silicone rubber supported on biaxially-stretchable glass fabric.

2. A surface-inhibited propellent charge as claimed in claim 1 wherein the propellent comprises a nitric ester and the silicone rubber is room temperature cured rubber.

3. A process for the preparation of a surface-inhibited propellent charge as claimed in claim 1 which comprises coating the surface of the propellent charge with a priming coat of uncured silicone rubber or resin, placing biaxially-stretchable glass fabric in contact with the priming coat, applying a coating of uncured silicone rubber to the glass fabric and curing the silicone.

4. A surface-inhibited propellent charge as in claim 1 wherein said propellent composition is selected from the group consisting of double-base propellents and composite propellents which comprise an organic fuel binder and a material selected from the group consisting of an organic nitramine and at least one salt selected from the group consisting of the ammonium, alkali metal and alkaline earth metal salts of nitric acid and the ammonium, alkali metal and alkaline earth metal salts of perchloric acid.

5. A surface-inhibited propellent charge as claimed in claim 1 wherein said supporting structure includes at least two layers of glass fabric.

6. A surface-inhibited propellent charge as claimed in claim 1 wherein the silicone rubber completely covers and impregnates the fabric.

7. A surface-inhibited propellent charge as claimed in claim 1 wherein said layer has a thickness in the range 0.75 to 2.5 millimeters.

8. A surface-inhibited propellent charge as claimed in claim 1 wherein the glass fabric comprises knitted glass fabric.

9. A surface-inhibited propellent charge as claimed in claim 1 wherein the glass fabric is in the form of a sleeve.

10. A surface-inhibited propellent charge as claimed in claim 1 wherein said fabric is made from glass yarn of 1,000 to 2,000 denier.

11. A surface-inhibited propellent charge as in claim 1 wherein said rubber is made from a material selected from the group consisting of polydimethylsiloxane and polydimethylsiloxane modified by the inclusion of a substituent selected from the group consisting of vinyl substituents and phenyl substituents cured by means of a free-radical curing agent.

12. A surface-inhibited propellent charge as claimed in claim 11 wherein the rubber has been cured by 2,4-dichlorobenzoyl peroxide.

13. A surface-inhibited propellent charge as claimed in claim 1 wherein the silicone rubber comprises R.T.V. rubber.

14. A surface-inhibited propellent charge as claimed in claim 13 wherein the room temperature cured rubber is made from hydroxyl-ended polydimethylsiloxane cured by means of a chain-extending and cross-linking agent.

15. A surface-inhibited propellent charge as claimed in claim 14 wherein the silicone rubber comprises room temperature cured rubber made from hydroxyl-ended polydimethylsiloxane cured by a curing composition selected from the group consisting of (a) a silicate ester in presence of an organo-tin compound, (b) an acetoxy silane in presence of water of (c) an oxime silane in presence of water.

16. A surface-inhibited propellent charge as claimed in claim 15 wherein the room temperature cured rubber has been cured by a curing agent selected from the group consisting of ethyl silicate, methyl triacetoxysilane or methyl tris(acetoximino) silane.

17. A surface-inhibited propellent charge as claimed in claim 16 wherein the room temperature cured rubber has been cured by a curing agent selected from the group consisting of a silicate ester and dibutyl-tin dilurate or stannous octoate.

18. A surface-inhibited propellent charge as claimed in claim 1 wherein the silicone rubber contains a filler.

19. A surface-inhibited propellent charge as claimed in claim 18 wherein the filler is selected from the group consisting of calcium carbonate, silica or iron oxide.

* * * * *